US007810456B2

(12) United States Patent
Kobayashi

(10) Patent No.: US 7,810,456 B2
(45) Date of Patent: Oct. 12, 2010

(54) STORAGE WATER HEATER

(75) Inventor: Toshihiro Kobayashi, Nagoya (JP)

(73) Assignee: Paloma Industries, Ltd., Nagoya-Shi (JP)

( * ) Notice: Subject to any disclaimer, the term of this patent is extended or adjusted under 35 U.S.C. 154(b) by 640 days.

(21) Appl. No.: 11/733,336

(22) Filed: Apr. 10, 2007

(65) Prior Publication Data

US 2007/0257123 A1 Nov. 8, 2007

(51) Int. Cl.
*F22B 1/02* (2006.01)

(52) U.S. Cl. ..... 122/31.1; 122/20 R; 237/19

(58) Field of Classification Search ..... 122/20 R, 122/31.1, 15.1, 18.1; 237/19, 8 R; 126/362.1, 126/361.1
See application file for complete search history.

(56) References Cited

U.S. PATENT DOCUMENTS 2,190,382 A * 2/1940 Moore ..... 237/19
2,201,406 A * 5/1940 Miller ..... 237/19
2,878,804 A * 3/1959 Gaffney ..... 122/14.31
4,492,091 A * 1/1985 Whitwell et al. ..... 62/180
4,699,091 A * 10/1987 Waters ..... 122/20 A
5,006,689 A * 4/1991 Kurachi et al. ..... 392/450
5,020,721 A * 6/1991 Horne ..... 236/20 R
5,203,500 A * 4/1993 Horne, Sr. ..... 237/19
5,317,670 A * 5/1994 Elia ..... 392/464
6,283,067 B1 * 9/2001 Akkala ..... 122/14.22

FOREIGN PATENT DOCUMENTS

JP 07-180909 A1 7/1995
JP 2001-304691 10/2001

* cited by examiner

*Primary Examiner*—Gregory A Wilson
(74) *Attorney, Agent, or Firm*—Burr & Brown

(57) ABSTRACT

To provide a storage water heater capable of increasing thermal efficiency and quickly boiling when tap water is supplied into a hot-water tank. A storage water heater can heat low-temperature water having a high density because hot water in a hot-water tank is led from a lead-in pipe positioned at the bottom of the hot-water tank to a gas heater. Also, a water supply pipe outlet and a lead-in pipe inlet are provided so as to be opposed to each other on the same axis. Therefore, when tap water is supplied from a water supply pipe, the tap water lower in temperature than the hot water in the hot-water tank is preferentially led to the gas heater. With this, hot water at the lowest temperature in the hot-water tank can be selectively heated, thereby increasing thermal efficiency.

5 Claims, 3 Drawing Sheets

STORAGE WATER HEATER

BACKGROUND OF THE INVENTION

This application is based on Japanese Patent Application Number 2006-028260 filed on Feb. 6, 2006, the entirety of which is incorporated by reference.

FIELD OF THE INVENTION

The present invention relates to a storage water heater and, in detail, to a storage water heater with a hot-water tank.

DESCRIPTION OF THE RELATED ART

Conventionally, a storage water heater with a hot-water tank for storing hot water has been known. Such a storage water heater includes, for example, a hot-water storage chamber 102 at an upper portion and a combustion chamber 103 at a lower portion in a hollow cylindrical body 101, as illustrated in FIG. 3. The hot-water storage chamber 102 includes a temperature detector 300 below a center portion. The combustion chamber 103 has an air inlet 104 through which air is supplied to the inside and an exhaust path 105 through which combustion gas in the combustion chamber 103 is exhausted to the outside, the path penetrating through an axial center position of the hot-water storage chamber 102 and being open at an upper portion of the cylindrical body 101. Also, the cylindrical body 101 has a bottom plate portion 107 that closes a lower end and a spherical upper plate 108 slightly swelling upward and closing an upper end. The upper plate 108 has a water supply pipe 109 and a hot-water supply pipe 110 hanging down in the hot-water storage chamber 102 and penetrating the upper plate 108. In the storage water heater with such a hot-water tank, when exhaust gas at high temperature burnt at the gas burner 113 provided in the combustion chamber 103 passes through the exhaust path 105, the exhaust gas heats water through thermal exchange with water supplied into the hot-water storage chamber 102. The hot water stored at a predetermined temperature is then provided to the outside appropriately through the hot-water supply pipe 110.

Since such a storage water heater with a tank for storing hot water stores a large amount of hot water, it is possible to use a large amount of hot water at one time. Also, since the configuration of the device is relatively simple, there is an advantage of low cost manufacturing.

[Patent Document 1] Japanese Patent Laid-Open Publication No. 2001-304691

However, in the storage water heater as described above, when the temperature of the hot water in the hot-water storage chamber 102 is high, a difference between the temperature of exhaust gas passing through the exhaust path 105 and the temperature of hot water in the hot-water storage chamber 102 becomes small, thereby posing a problem that thermal efficiency is decreased. Moreover, in a wait state where the gas burner 113 is not operated for burning, the temperature in the exhaust path 105 becomes lower than the temperature of the hot water in hot-water storage chamber 102, and heat is dissipated from the inside of the hot-water storage chamber 102 to the outside via the exhaust path 105, thereby posing a problem that the temperature in the hot-water storage chamber 102 decreases unnecessarily. Moreover, since a temperature detector 300 and a water supply pipe outlet 119 are distanced apart, there is a problem that, even when water is supplied through the water supply pipe 109 into the hot-water storage chamber 102 to decrease the temperature of the hot water in the hot-water storage chamber 102, it takes a certain time until the temperature detector 300 detects a decrease of the temperature of the hot water in the hot-water storage chamber 102. Still further, although a storage water heater with a heating means provided outside of a hot-water tank has been known, tap water supplied into the hot-water tank has not yet been efficiently led to the heating means so far. Therefore, there is a room for increasing thermal efficiency. There is also a problem that, when tap water is supplied into the hot-water tank, it takes a certain time until the temperature detector detects a decrease in water temperature after the temperature of the hot water in the hot-water tank falls.

The present invention has been devised to solve the above problems. An object of the present invention is to increase thermal efficiency of a storage water heater with a tank for storing hot water and reduce heat loss in a wait state where a burner is not operated for burning. A further object is to provide a storage water heater with high usability in which, when tap water is supplied into a hot-water tank, water is boiled to an appropriate temperature before the temperature of the hot water in a hot-water storage chamber is completely decreased.

SUMMARY OF THE INVENTION

To achieve the objects above, a storage water heater of the invention according to a first aspect includes: a hot-water tank that stores hot water; a water supply pipe through which water is supplied into the hot-water tank; a heating means provided outside of the hot-water tank to heat the hot water in the hot-water tank; a lead-in pipe that takes out the hot water from inside of the hot-water tank to lead into the heating means; a lead-out pipe that leads out warm water heated by the heating means into the hot-water tank; and a hot-water output pipe through which the hot water stored in the hot-water tank is output, wherein an inlet of the lead-in pipe is positioned on a bottom portion or a lower portion of the hot-water tank and is positioned at a height equal to or lower than a height of an outlet of the water supply pipe.

Also, in a storage water heater of the invention according to a second aspect, in addition to the structure of the invention according to the first aspect, the outlet of the water supply pipe and the inlet of the lead-in pipe are provided so as to be opposed to each other on a same axis.

Furthermore, in a storage water heater of the invention according to a third aspect, in addition to the structure of the invention according to the first or second aspect, the outlet of the water supply pipe is open downward and the inlet of the lead-in pipe is positioned below the outlet of the water supply pipe and is open upward.

Still further, in a storage water heater of the invention according to a fourth aspect, in addition to the structure of the invention according to any of the first to third aspects, the inlet of the lead-in pipe is formed in a shape with an end being widened.

Still further, in a storage water heater of the invention according to a fifth aspect, in addition to the structure of the invention according to any of the first to fourth aspects, the outlet of the water supply pipe and the inlet of the lead-in pipe are both positioned on a center axis of the hot-water tank.

Still further, in a storage water heater of the invention according to a sixth aspect, in addition to the structure of the invention according to any of the first to fifth aspects, a temperature detecting means is provided between the outlet of the water supply pipe and the inlet of the lead-in pipe.

In the storage water heater of the invention according to a first aspect, the configuration is such that a heating means is provided outside of the hot-water tank and hot water in the hot-water tank is led to the heating device through the lead-in pipe. Therefore, unlike a conventional storage water heater provided with a combustion chamber inside of the hot-water tank, there is no need to provide an exhaust path in the hot-water tank. Therefore, even in a wait state where the temperature on the exhaust path is lower than the temperature of the hot water in the hot-water tank, heat is not dissipated from the inside of the hot-water tank to the outside via the exhaust path, thereby reducing unnecessarily dissipation of heat in the wait state. Also, an inlet of the lead-in pipe leading hot water from the inside of the hot-water tank to the heating means is positioned at a bottom portion or a lower portion of the hot-water tank. Therefore, low-temperature water with a high density at a lower portion of the hot-water tank is selectively led to the heating means, thereby increasing heat efficiency. Furthermore, when tap water is supplied through the water supply pipe, the tap water stays below the water supply pipe outlet because the temperature of the tap water is lower than that of the warm water which was pre-stored in the hot-water tank and has a high density. In the present invention, the lead-in pipe is positioned at the height equal to or lower than a height of the water supply pipe outlet. Therefore, low-temperature tap water which is staying below the outlet of the water supply pipe can be selectively led to the heating means. With this, heat efficiency where tap water is supplied into the hot-water tank can be increased.

In the storage water heater of the invention according to a second aspect, in addition to the effects of the invention according to the first aspect, the following operation effects can be achieved. That is, tap water which is supplied into the hot-water tank is discharged from the outlet of the water supply pipe toward the inlet of the lead-in pipe provided so as to be opposed to the outlet of the water supply pipe on the same axis. Therefore, when tap water is supplied, the tap water is preferentially led to the heating means. That is, the tap water lower in temperature than the warm water pre-stored in the hot-water tank is preferentially heated, thereby further increasing heat efficiency.

In the storage water heater of the invention according to a third aspect, in addition to the effects of the invention according to the first or second aspect, the following effects can be achieved. That is, tap water supplied into the hot-water tank is discharged downward from the outlet of the water supply pipe that is open downward. Since the tap water has a density higher than that of warm water pre-stored in the hot-water tank, the tap water stays below the outlet of the water supply pipe. The tap water staying at a lower portion of the hot-water tank is led to the heating means through the inlet of the lead-in pipe that is open upward below the outlet of the water supply pipe, thereby increasing heat efficiency. In particular, when the outlet of the water supply pipe and the inlet of the lead-in pipe are provided so as to be vertically opposed on the same axis, tap water is smoothly led to the inlet of the lead-in pipe from the outlet of the water supply pipe. In this case, thermal efficiency can be further increased.

In the storage water heater of the invention according to a fourth aspect, in addition to the effects of the invention according to any of the first to third aspects, the following effects can be achieved. That is, firstly, when the inlet of the lead-in pipe is open in a shape being widened upward, low-temperature water with a high density smoothly flows downward from the inlet opening with a wide area toward the inside of the lead-in pipe. Therefore, the low-temperature water is led to the heating means, thereby increasing thermal efficiency. In particular, when the outlet of the water supply pipe and the inlet of the lead-in pipe are provided so as to be opposed to each other on the same axis, the resistance at the inlet of the lead-in pipe is small. Therefore, the flow of the tap water discharged from the outlet of the water supply pipe is led to the lead-in pipe without disturbance. With this, mixture of warm water inside the hot-water tank can be reduced, thereby further increasing heat efficiency.

In the storage water heater of the invention according to a fifth aspect, in addition to the effects of the invention according to any of the first to fourth aspects, the following effects can be achieved. Tap water is sent into the hot-water tank from the outlet of the water supply pipe positioned on the center axis of the hot-water tank, and hot water at a lower portion in the hot-water tank is taken out from the inlet of the lead-in pipe at the bottom portion or the lower portion of the hot-water tank on the center axis. Therefore, tap water supplied to the inside of the hot-water tank does not stay for a long time. Therefore, thermal efficiency of the entire storage water heater can be increased.

In the storage water heater of the invention according to a sixth aspect, in addition to the effects of the invention according to any of the first to fifth aspects, the following operation effects can be achieved. When low-temperature tap water is supplied into the hot-water tank from the outlet of the water supply pipe, a decrease in the temperature of the hot water is immediately detected by the temperature detecting means installed between the outlet of the water supply pipe and the inlet of the lead-in pipe, thereby starting heating of the hot water in the hot-water tank by the heating means. That is, heating is started by the heating means before the temperature of the hot water in the hot-water tank is completely decreased, thereby keeping the temperature of the hot water in the hot-water tank at an appropriate temperature. With this, a storage water heater with high usability can be achieved.

DETAILED DESCRIPTION OF THE INVENTION

Figure 1:
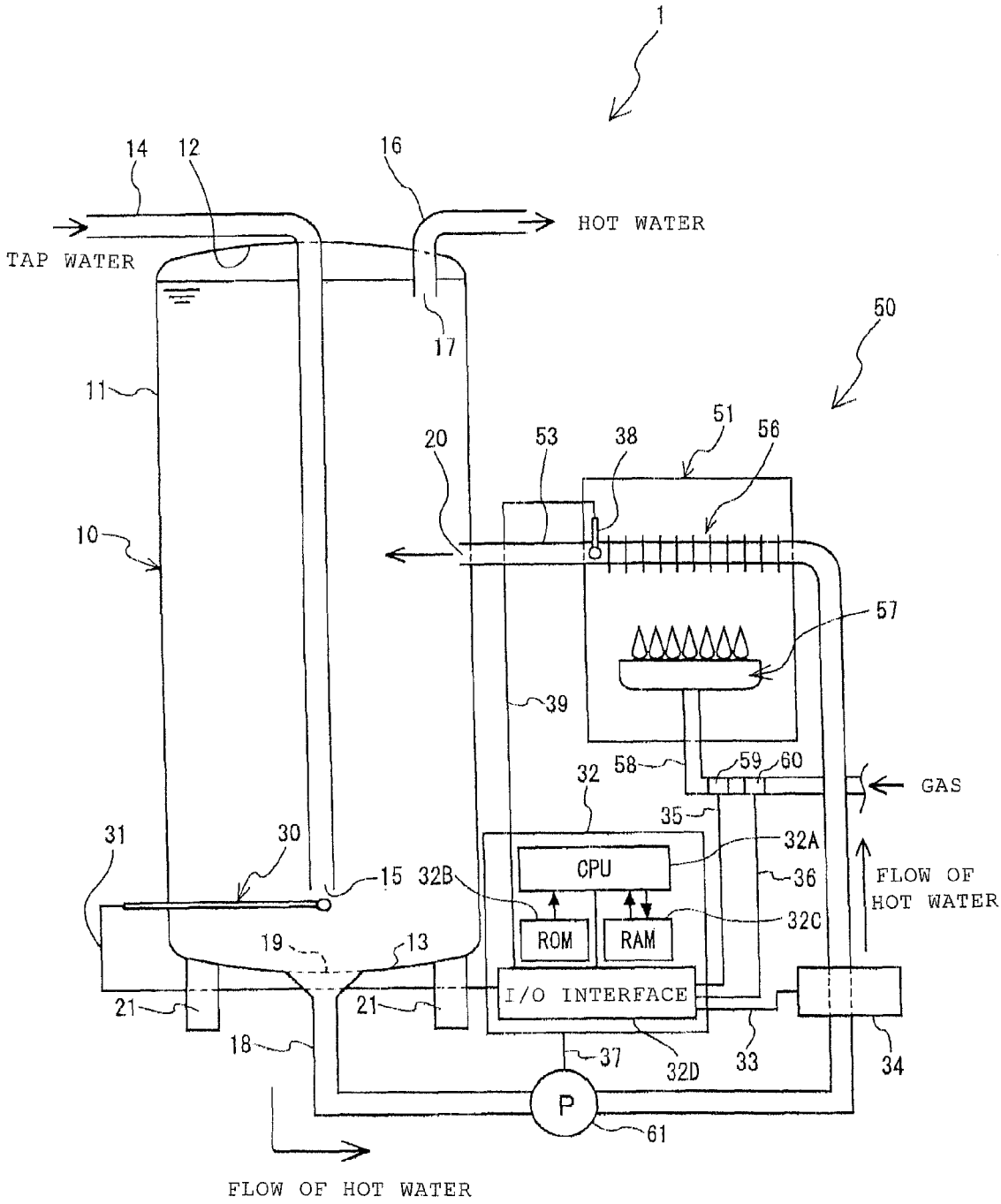
FIG. 1 is a schematic configuration drawing of a storage water heater 1 of the present embodiment.
Figure 2:
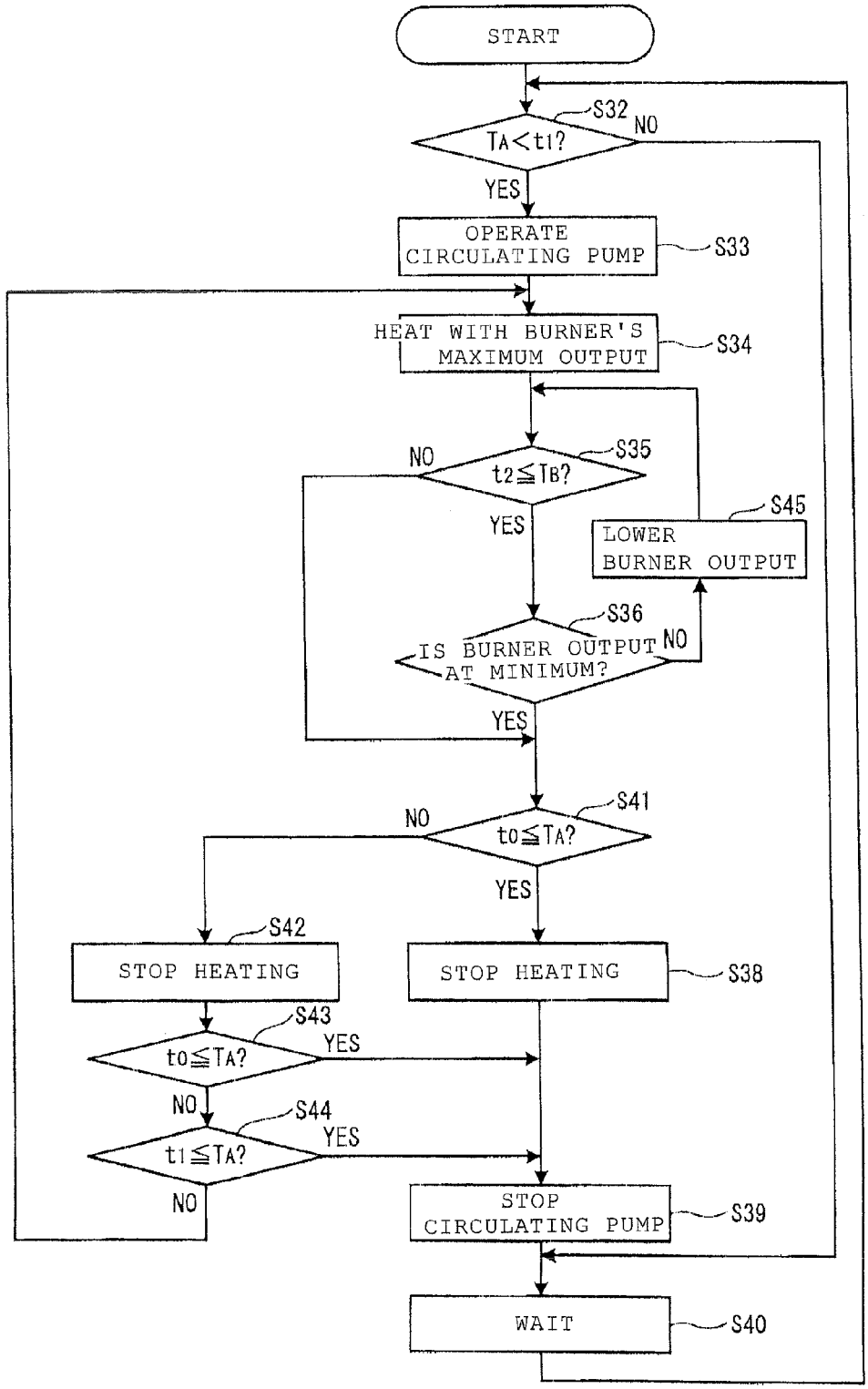
FIG. 2 is a flowchart of a control operation of a controller 32 in the present embodiment.
Figure 3:
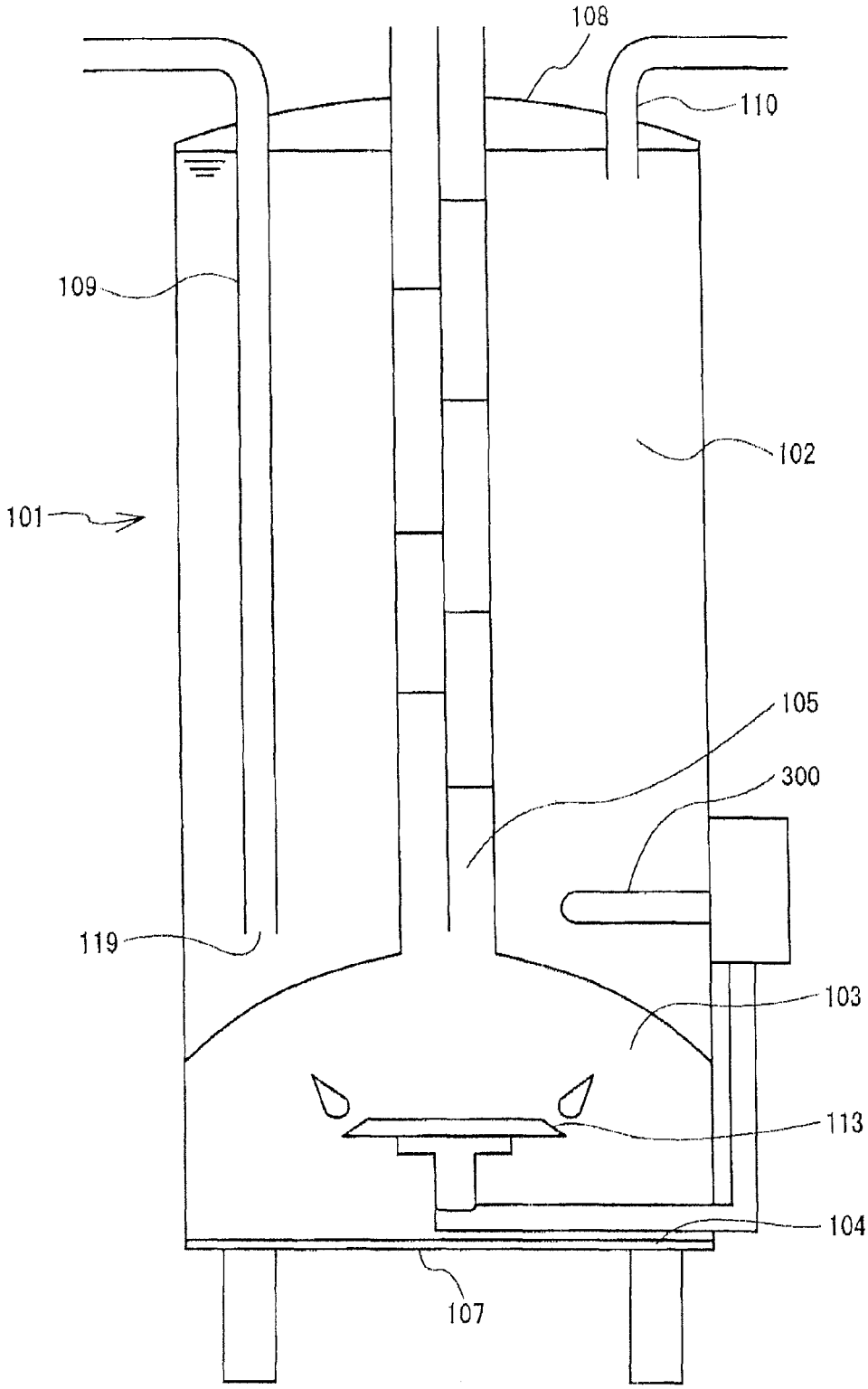
FIG. 3 PRIOR ART
FIG. 3 is a front section view schematically depicting a storage water heater with a tank for storing hot water of a conventional example.

A storage water heater 1 according to one embodiment of the present invention is described below based on the drawings. FIG. 1 is a schematic configuration drawing of the storage water heater 1 of the present embodiment, and FIG. 2 is a flowchart of a control operation of a controller 32 in the present embodiment.

First, the storage water heater 1 is schematically described. As illustrated in FIG. 1, the storage water heater 1 is formed mainly of a hot-water tank 10 for storing hot water, a circulating heating unit 50 that circulates and heats the hot water stored in the hot-water tank 10, and a controller 32 that controls the operation of the storage water heater 1.

The hot-water tank 10 is first described. As illustrated in FIG. 1, the hot-water tank 10 is a tank made of metal or resin with its side surface being in cylindrical shape. The hot-water tank 10 has a spherical lower panel 13 closing a lower end and swelling downward and a spherical upper panel 12 closing an upper end and swelling upward. In the case of the tank made of metal, the inner surface of this hot-water tank 10 is enameled, and the outer surface thereof is covered by a thermal-insulating material (not shown) made of polyurethane resin or the like. Also, the hot-water tank 10 has four corners at its bottom portion each provided with a leg 21. The hot-water tank 10 is installed by means of four legs 21 (only two legs are shown in FIG. 1) installed on the floor.

The upper plate 12 has a water supply pipe 14 for allowing tap water to flow from outside into the hot-water tank 10 and a hot-water output pipe 16 for allowing hot water in the hot-water tank 10 to flow out to the outside, both penetrating through the upper plate 12. The water supply pipe 14 is provided so as to hang down on the center axis of the hot-water tank 10, with an end (hereinafter, a water supply pipe outlet) 15 on a downstream side being extended to a lower portion of the hot-water tank 10.

The lower plate 13 has a lead-in pipe 18 that leads hot water in the hot-water tank 10 to a gas heater 51, which will be described further below. This lead-in pipe 18 has an end (hereinafter, an lead-in pipe inlet) 19 on an upstream side provided at the bottom of the hot-water tank 10 so as to be opposed to the water supply pipe outlet 15 on the same axis, that is, in the present embodiment, the lead-in pipe inlet 19 is provided so as to be open upward on the center axis of the hot-water tank 10. Also, the lead-in pipe inlet 19 has an opening formed so as to be gradually widened upward.

Between the water supply pipe outlet 15 and the lead-in pipe inlet 19, an in-tank hot-water temperature detection sensor 30 for detecting the temperature of the hot water stored in the hot-water tank 10 is provided so as to approximately horizontally penetrate through a sidewall and protrude into the hot-water tank 10. This in-tank hot-water temperature detection sensor 30 is electrically connected to the controller 32 via a wiring 31.

In the above-structured hot-water tank 10, a water supply pressure is always applied from the water supply pipe 14. Thus, if a tap is opened, tap water flows from the water supply pipe 14 into the hot-water tank 10 to push the hot water in the hot-water tank 10 for discharging the hot water. Therefore, the hot-water tank 10 is always in a state of being filled with a predetermined amount of hot water.

Next, the circulating heating unit 50 is described. As illustrated in FIG. 1, the circulating heating unit 50 includes the gas heater 51 for heating hot water in the hot-water tank 10, the lead-in pipe 18 that leads the hot water in the hot-water tank 10 to the gas heater 51, a connecting pipe 53 through which the hot water heated by the gas heater 51 is returned to the inside of the hot-water tank 10, and a circulating pump 61 installed in the mid-course of the lead-in pipe 18.

A downstream-side end 20 of the connecting pipe 53 is provided on a side wall above the center of the hot-water tank 10. On an upstream side of the connecting pipe 53, a heated-hot-water temperature detection sensor 38 is provided that detects the temperature of the hot water heated by the gas heater 51. This heated-hot-water temperature detection sensor 38 is connected to the controller 32 via a wiring 39.

The circulating pump 61 is a pump for sending the hot water in the hot-water tank 10 to the gas heater 51. This circulating pump 61 is electrically connected to the controller 32 via a wiring 37. Here, the circulating heating unit 50 according to the present embodiment is of a forced circulation type with the circulating pump 61, but may be a circulating heating unit of a natural circulation type without the circulating pump 61.

On the other hand, the gas heater 51 includes a gas burner 57 that burns fuel gas and a thermal exchanging unit 56 that heats a flow of water by using fuel gas generated by the gas burner 57. The gas burner 57 has connected thereto a gas supply pipe 58 for supplying fuel gas to the gas burner 57. In the mid-course of the conduit of the gas supply pipe 58, a main solenoid valve 60 and a gas proportional valve 59 are provided. These main solenoid valve 60 and gas proportional valve 59 are electrically connected to the controller 32 via wirings 36 and 35, respectively. Here, the gas heater 51 depicted in FIG. 1 corresponds to a "heating means".

Next, the controller 32 is described. This controller 32 includes a CPU 32A as a central arithmetic operation processing device, a ROM 32B and a RAM 32C mutually connected to each other centering on the CPU 32A, and an I/O interface 32D. The RAM 32C is a readable and writable memory temporarily storing a running program and storing various data and others, whilst the ROM 32B is a read-only memory storing various programs and others incorporated therein. The operation of the storage water heater 1 is controlled by the CPU 32A of the controller 32. The above-structured controller 32 has connected thereto via the wiring 31, 37, 36, and 35 the in-tank hot-water temperature detection sensor 30, the circulating pump 61, the main solenoid valve 60, and the gas proportional valve 59, respectively, and others.

Also, the controller 32 has connected thereto a setting unit 34 via a wiring 33. This setting unit 34 includes an operation switch which is not shown, a screen display unit for displaying a hot-water temperature inside the hot-water tank 10, and a numeric keypad which is not shown for setting a target temperature or the like of the hot water inside the hot-water tank 10. A set value set by the setting unit 34 is converted to a setting signal for output to the controller 32.

Here, reference temperatures set for controlling the hot-water temperature of the hot-water tank 10 are described. In the present embodiment, to keep the temperature of the hot water stored in the hot-water tank 10, three reference temperatures are stored in the ROM 32B in the controller 32. These three temperatures are a target temperature (t0) targeted at the time of boiling the hot water in the hot-water tank 10, a first reference temperature (t1) as a measure of starting heating by the gas heater 51, and a second reference temperature (t2) as a measure of stopping heating by the gas heater 51. Here, in the present embodiment, as an example of these reference temperatures, the target temperature t0 is set at 60 degrees Celsius, the first reference temperature t1 is set at 50 degrees Celsius, and the second reference temperature t2 is set at 65 degrees Celsius.

Next, the control operation of the storage water heater 1 by the CPU 32A of the controller 32 is described with reference to a flowchart of FIG. 2. First, when the operation switch of the setting unit 34 is turned ON, a hot-water temperature in the hot-water tank TA is detected by the in-tank hot-water temperature detection sensor 30 and it is determined whether the hot-water temperature in the hot-water tank TA is lower than the first reference temperature t1 (50 degrees Celsius) (S32). Here, if the hot-water temperature in the hot-water tank TA is equal to or higher than the first reference temperature t1 (50 degrees Celsius) ("NO" at S32), the temperature is near 60 degrees of the target temperature t0, and therefore heating is not required. Therefore, a wait state continues as it is without any operation of the gas heater 51 or the circulating pump 61 (S40). In this case, the procedure returns to S32 for repeating the process.

On the other hand, if the hot-water temperature in the hot-water tank TA detected by the in-tank hot-water temperature detection sensor 30 is lower than the first reference temperature t1 (50 degrees Celsius) ("YES" at S32), the hot-water temperature in the hot-water tank 10 is decreasing. Therefore, the hot water in the hot-water tank 10 is started to be heated by the gas heater 51. In this case, the operation of the circulating pump 61 is first started (S33) to take out the hot water in the hot-water tank 10 from the bottom portion of the hot-water tank 10 via the lead-in pipe 18 to lead to the gas heater 51. Then, the main solenoid valve 60 and the gas proportional valve 59 of the gas supply pipe 58 are both opened to supply fuel gas to the gas burner 57. Also, with an igniter not shown, an operation of igniting the gas burner 57 is performed (S34). At this time, the gas proportional valve 59 is full-open, and the output of the gas burner 57 is at maximum.

The hot water led to the gas heater 51 is heated by combustion heat of the gas burner 57 in the thermal exchanging unit 56, and is then returned from the side surface of the hot-water tank 10 to the upper side thereof via the connecting pipe 53. At this time, the heated-hot-water temperature detection sensor 38 installed at the outlet of the thermal exchanging unit 56 detects a temperature TB which is a temperature of hot water immediately after heating (S35). If the temperature TB is equal to or higher than the second reference temperature t2 (65 degrees Celsius) ("YES" at S35), the output of the gas burner 57 is lowered until the output of the gas burner 57 is at minimum ("NO" at S36, S45). This output of the gas burner 57 is produced by controlling the gas proportional valve 59 to change the amount of gas to be supplied to the gas burner 57. If the output of the gas burner 57 is at minimum ("YES" at S36), the in-tank hot-water temperature detection sensor 30 determines whether the hot-water temperature in the hot-water tank TA has reached the target temperature t0 (60 degrees Celsius) (S41).

Also, if the heated-hot-water temperature detection sensor 38 detects that the temperature TB, which is a temperature of hot water immediately after heating, is lower than the second reference temperature t2 (65 degrees Celsius) at S35 ("NO" at S35), the temperature in the hot-water tank 10 is further detected by the in-tank hot-water temperature detection sensor 30 without changing the output of the gas burner 57 (S41).

Then, when the hot-water temperature in the hot-water tank TA is detected (S41), if the hot-water temperature in the hot-water tank TA has reached the target temperature t0 (60 degrees Celsius) ("YES" at S41), heating by the gas heater 51 is stopped (S38). Heating is stopped by closing both of the main solenoid valve 60 and the gas proportional valve 59 to stop supply of gas to the gas burner 57 and extinguish flames of the gas burner 57. Thereafter, the circulating pump 61 is stopped (S39) to stop circulation of hot water, thereby causing a wait state (S40).

On the other hand, if it is determined at S41 that the hot-water temperature in the hot-water tank TA is lower than the target temperature t0 (60 degrees Celsius) ("NO" at S41), heating by the gas burner 57 is once stopped (S42). Then forced circulation is performed by the circulating pump 61 to equalize the temperature of the hot water in the storage water heater 1. Then, the hot-water temperature in the hot-water tank TA is again measured (S43). Then, if the re-measured hot-water temperature in the hot-water tank TA has reached the target temperature t0 (60 degrees Celsius) ("YES" at S43), the circulating pump 61 is stopped (S39), thereby causing a wait state (S40).

Also, if it is determined at S43 that the hot-water temperature in the hot-water tank TA has not reached the target temperature t0 (60 degrees Celsius) ("NO" at S43) it is further determined whether the hot-water temperature in the hot-water tank TA has reached the first reference temperature t1 (50 degrees Celsius) as a criterion in determining the start of heating (S44). If the hot-water temperature in the hot-water tank TA has reached the first reference temperature t1 (50 degrees Celsius) ("YES" at S44), the circulating pump 61 is stopped (S39), thereby causing a wait state (S40). However, if TA has not reached ("NO" at S44), heating is restarted with the maximum output of the gas burner 57 (S34), thereby continuing circulating heating at the circulating heater 50.

In a wait state (S40), the hot water in the hot-water tank 10 is not heated and its heat is dissipated to the outside. Therefore, the hot-water temperature in the hot-water tank 10 is gradually decreased from a lower portion of the hot-water tank 10. Then, if the hot-water temperature in the hot-water tank TA detected by the in-tank hot-water temperature detection sensor 30 becomes equal to or lower than the first reference temperature t1 (50 degrees Celsius) ("YES" at S32), the circulating pump 61 is operated again (S33) to start heating by the gas burner 57 (S34). In this manner, when an abrupt change in hot-water temperature in the hot-water tank 10 is not present, a circulating heating state and a wait state are alternately repeated. As a result, the temperature in the hot-water tank 10 is kept near 50 degrees Celsius to 60 degrees Celsius.

At this time, the hot water in the hot-water tank 10 is led, warm water at low temperature first, to the gas heater 51 via the lead-in pipe 18 positioned at the bottom of the hot-water tank 10. Then, after being heated by the thermal exchanging unit 56, the hot water is then returned to an upper side of a middle stage in the hot-water tank 10 via the connecting pipe 53. Therefore, hot water at a low temperature is preferentially taken out by the circulating heating unit 50 for heating. Also, since the lead-in pipe inlet 19 is open in a shape being widened upward, low-temperature water with a high density smoothly flows downward from the lead-in pipe inlet 19 with a large area toward the inside of the lead-in pipe 18. Moreover, since the lead-in pipe inlet 19 is provided at the bottom of the hot-water tank 10 on the center axis, the low-temperature water in the hot-water tank 10 is led to the lead-in pipe 18 without unnecessarily staying in the hot-water tank 10. In this manner, when an abrupt change in hot-water temperature in the hot-water tank 10 is not present and a circulating heating state and a wait state are alternately repeated, the storage water heater 1 is configured in a manner such that the low-temperature water in the hot-water tank 10 is preferentially led to the gas heater 51, thereby achieving high heat efficiency.

On the other hand, when tap water is supplied into the hot-water tank 10, the tap water is discharged from the water supply pipe outlet 15 toward the lead-in pipe inlet 19. With the lead-in pipe inlet 19 being formed in a funnel shape, the flow of the tap water is led to the lead-in pipe 18 without disturbance. In this manner, the configuration is such that, when tap water is supplied, the tap water is not mixed with the hot water in the hot-water tank 10, and the tap water, whose temperature is lower than that of the hot water in the hot-water tank 10, is preferentially led to the gas heater 51. Thus, even when tap water is supplied into the hot-water tank 10, high thermal efficiency can be achieved.

Furthermore, when tap water is supplied into the hot-water tank 10, the tap water is discharged in the hot-water tank 10 toward the in-tank hot-water temperature detection sensor 30. Therefore, when tap water is supplied into the hot-water tank 10, a decrease in hot-water temperature in the hot-water tank 10 is immediately detected by the in-tank hot-water temperature detection sensor 30. Therefore, heating by the gas heater 51 can be started before the hot-water temperature in the hot-water tank 10 is decreased. With this, the user can always use warm water at an appropriate temperature.

As has been described above, in the storage water heater 1 according to the present embodiment, when the temperature in the hot-water tank 10 is lower than the first reference temperature t1 (50 degree Celsius), the hot water in the hot-water tank 10 is led to the gas heater 51, hot water at a low temperature first, via the lead-in pipe 18 positioned at the bottom of the hot-water tank 10. Then, after being heated at the thermal exchanging unit 56, the hot water is returned via the connecting pipe 53 to an upper side of the middle stage of the inside of the hot-water tank 10. In this manner, in the hot-water tank 10, hot water heated to a high temperature moves upward, whilst hot water at a low temperature moves downward. Thus, the hot water at a low temperature is preferentially led to the circulating heating unit 50 for heating. With this, thermal efficiency with the gas heater 51 can be increased.

Also, since the lead-in pipe inlet 19 is provided at the bottom of the hot-water tank 10 on the center axis, the hot water in the hot-water tank 10 is led to the lead-in pipe 18 without unnecessarily staying in the hot-water tank 10. That is, the hot water at a low temperature can be led to the gas heater 51 without unnecessarily staying in the hot-water tank 10, thereby increasing thermal efficiency.

Furthermore, the water supply pipe outlet 15 and the lead-in pipe inlet 19 are provided so as to be opposed to each other on the same axis. Therefore, when tap water is supplied into the hot-water tank 10, the tap water is discharged from the water supply pipe 14 to the lead-in pipe inlet 19. With this, the tap water is preferentially led from the lead-in pipe inlet 19 to the lead-in pipe 18. That is, the tap water at a lower temperature is preferentially heated compared with the hot water pre-stored in the hot-water tank 10, thereby further increasing thermal efficiency.

Moreover, since the lead-in pipe inlet 19 is opened in a shape being widened upward, low-temperature water with a high density smoothly flows downward from the lead-in pipe inlet 19 with a large area toward the inside of the lead-in pipe 18. Furthermore, when tap water is supplied from the water supply pipe outlet 15 toward the lead-in pipe inlet 19, since the resistance near the lead-in pipe inlet 19 is small, the flow of tap water is led to the lead-in pipe 18 without disturbance. That is, it is possible to reduce a mixture of the hot water in the hot-water tank 10 due to a disturbance in the flow and preferentially lead the tap water to the gas heater 51, thereby further increasing thermal efficiency.

In addition, since the in-tank hot-water temperature detection sensor 30 is provided between the water supply pipe outlet 15 and the lead-in pipe inlet 19, when tap water is supplied from the water supply pipe outlet 15, a decrease in temperature in the hot-water tank 10 is immediately detected to start heating by the gas heater 51. That is, heating is started before the hot-water temperature in the hot-water tank 10 is completely decreased, thereby keeping the hot-water temperature in the hot-water tank 10 at an appropriate temperature. With this, usability of the storage water heater 1 can be increased.

Here, it is needless to say that the present invention is not restricted to the above embodiment and can be variously modified. For example, although the present embodiment is of a forced circulation type with the circulating pump 61 provided in the mid-course of the lead-in pipe 18, the device may be of a natural circulation type for circulation by using a difference in temperature in the circulating heater 50 without having the circulating pump 61. Moreover, although the end 20 on the downstream side of the connecting pipe 53 is placed on the side surface of the hot-water tank 10 in the present embodiment, the end 20 on the downstream side may be placed on the bottom surface of the hot-water tank 10. In this case, a harmful effect can be prevented in which, in a wait state where heating is not performed by the gas burner 57, the hot water in the circulating heater 50 is cooled to backflow into the hot-water tank 10.

The present invention is applicable to a storage water heater with a hot-water tank.

What is claimed is:

1. A storage water heater comprising:

a hot-water tank that stores hot water;

a water supply pipe through which water is supplied into the hot-water tank;

a heating means provided outside of the hot-water tank to heat the hot water in the hot-water tank;

a lead-in pipe that takes out the hot water from inside of the hot-water tank to lead into the heating means;

a lead-out pipe that leads out warm water heated by the heating means into the hot-water tank; and a hot-water output pipe through which the hot water stored in the hot-water tank is output, wherein an inlet of the lead-in pipe is positioned on a bottom portion or a lower portion of the hot-water tank and is positioned at a height equal to or lower than a height of an outlet of the water supply pipe, wherein the outlet of the water supply pipe and the inlet of the lead-in pipe are provided so as to be opposed to each other on a same axis.

2. The storage water heater according to claim 1, wherein the outlet of the water supply pipe is open downward and the inlet of the lead-in pipe is positioned below the outlet of the water supply pipe and is open upward.

3. The storage water heater according to claim 1, wherein the inlet of the lead-in pipe is formed in a shape with an end being widened.

4. The storage water heater according to claim 1, wherein the outlet of the water supply pipe and the inlet of the lead-in pipe are both positioned on a center axis of the hot-water tank.

5. The storage water heater according to claim 1, wherein a temperature detecting means is provided between the outlet of the water supply pipe and the inlet of the lead-in pipe.

* * * * *